US010179092B2

(12) United States Patent
Plavan et al.

(10) Patent No.: US 10,179,092 B2
(45) Date of Patent: Jan. 15, 2019

(54) STAND FOR SUPPORTING A BABY BOTTLE AND A METHOD THEREOF

(71) Applicants: David Marshall Plavan, Westfield, MA (US); Fanony B Montoya-Plavan, Westfield, MA (US)

(72) Inventors: David Marshall Plavan, Westfield, MA (US); Fanony B Montoya-Plavan, Westfield, MA (US)

( * ) Notice: Subject to any disclaimer, the term of this patent is extended or adjusted under 35 U.S.C. 154(b) by 0 days.

(21) Appl. No.: 15/254,083

(22) Filed: Sep. 1, 2016

(65) Prior Publication Data

US 2017/0071829 A1 Mar. 16, 2017

Related U.S. Application Data

(60) Provisional application No. 62/218,176, filed on Sep. 14, 2015.

(51) Int. Cl.
*A61J 9/06* (2006.01)

(52) U.S. Cl.
CPC ..... *A61J 9/0684* (2015.05); *A61J 9/0638* (2015.05); *A61J 9/0692* (2015.05)

(58) Field of Classification Search
CPC ..... A61J 9/0684; A61J 9/06; A61J 9/0607–9/0692; Y10T 403/453; Y10T 403/54; F16M 11/40; F16M 11/24; F16M 11/26
USPC .... 248/102–107, 125.8, 160, 161, 157, 688; 403/109.1–109.8
See application file for complete search history.

(56) References Cited

U.S. PATENT DOCUMENTS 1,863,163 A * 6/1932 Malti ..... A61J 9/0638 248/102
2,211,227 A * 8/1940 Feindel ..... A61J 9/0684 248/106
2,481,773 A * 9/1949 Nelson ..... A61J 9/0684 248/107
2,542,694 A * 2/1951 Miller ..... A61J 9/0638 248/107
2,717,753 A * 9/1955 Schweikert ..... A61J 9/0684 248/106
2,784,261 A * 3/1957 Anklesaria ..... H04M 1/04 248/103
3,090,466 A * 5/1963 Wright ..... E06C 7/44 182/202
3,151,828 A * 10/1964 Alloy ..... A61J 9/0661 248/104
3,182,942 A * 5/1965 Flanigan ..... A61J 9/0638 248/107
3,342,443 A * 9/1967 Bennyhoff ..... A61J 9/06 248/104
3,519,231 A * 7/1970 Miller ..... A61J 9/0692 248/106

(Continued)

FOREIGN PATENT DOCUMENTS

WO 9725906 A1 7/1997
WO 2014092190 A1 12/2013

*Primary Examiner* — Ingrid M Weinhold
(74) *Attorney, Agent, or Firm* — Law Office of Ilya Libenzon

(57) ABSTRACT

A bottle stand includes a bottle holder and at least one posably flexible leg having a proximal end attached to the bottle holder and a distal end resting on a surface, the leg comprising a first member and a second member telescopically coupled to the first member.

11 Claims, 11 Drawing Sheets

(56) References Cited

U.S. PATENT DOCUMENTS 3,635,431 A * 1/1972 Mariner ..... A61J 9/0638 248/104
3,794,141 A * 2/1974 Sturm ..... E06C 7/44 182/202
3,850,393 A 11/1974 Marquard
3,880,388 A * 4/1975 Beguin ..... A47B 91/16 182/202
4,296,902 A 10/1981 Dachtler
4,315,654 A 2/1982 Crook
4,733,836 A 3/1988 Barnes
5,037,046 A * 8/1991 Mingledorff, Jr. .... A61J 9/0638 248/106
5,072,843 A 12/1991 James
5,188,320 A 2/1993 Polka
5,192,041 A * 3/1993 Bryant ..... A61J 9/0692 248/104
5,794,898 A * 8/1998 Bradley ..... A61J 9/0638 248/102
6,098,934 A 8/2000 Skelton
6,250,592 B1 * 6/2001 Davis ..... A61J 9/0692 248/102
6,386,490 B1 * 5/2002 Suh ..... A61J 9/0692 248/102
6,523,793 B1 2/2003 Higgins
6,568,643 B2 5/2003 Black
6,598,837 B1 7/2003 Howard et al.
6,598,838 B2 7/2003 Suh
6,915,991 B1 * 7/2005 Shomer ..... A61J 9/0638 248/106
7,080,810 B2 7/2006 Munjed
7,472,871 B1 * 1/2009 Demontegnac ..... A61J 9/0692 248/102
8,267,147 B2 * 9/2012 Lockwood ..... A41D 13/1184 160/351
2005/0103954 A1 * 5/2005 Touma ..... A61J 9/0638 248/103
2009/0127896 A1 5/2009 Madden
2009/0189027 A1 * 7/2009 Brown ..... A61J 9/0692 248/104
2010/0019107 A1 * 1/2010 McCloud ..... A61M 16/0875 248/83

* cited by examiner

STAND FOR SUPPORTING A BABY BOTTLE AND A METHOD THEREOF

TECHNICAL FIELD

This invention relates generally to infant care articles in general, and particularly to an apparatus to aid in feeding infants.

BACKGROUND ART

One of the many demanding tasks involved in caring for an infant is regularly feeding the infant breast milk or formula. Babies require frequent feedings, and though they gradually gain more coordination as they develop, they lack the ability to feed themselves during most of their infancy. As parents or caretakers must frequently engage in multiple tasks to care for a baby while working or organizing a household, the amount of time required to feed the baby can be a significant burden.

Therefore, there remains a need for a device that allows an infant to feed from a bottle somewhat autonomously.

SUMMARY

In one aspect, a bottle stand includes a bottle holder. The bottle stand includes at least one posably flexible leg having a proximal end attached to the bottle holder and a distal end resting on a surface, the leg having a first member and a second member telescopically coupled to the first member.

In a related embodiment, the bottle holder further includes at least loop. In another related embodiment, the bottle holder also includes a bottle holder pad. In a further embodiment, the bottle holder pad tapers from a first thickness at a first end of the bottle holder pad to a second thickness at a second end of the bottle holder pad, and the second thickness is less than the first thickness. In another embodiment, the bottle holder further includes a bottle holder sleeve. In an additional embodiment, the interior of the sleeve is funnel-shaped. In yet another, the at least one leg includes at least two legs. In still another embodiment, the at least one leg further includes at least one wire connected to the bottle holder at the proximal end. In a further embodiment, the at least one leg also includes at least one foot at the distal end of the at least one leg. In an additional embodiment, the at least one foot also includes a high-friction pad that rests on the surface. In a further embodiment still, the at least one foot also includes a weight.

In another related embodiment, the first portion further includes a flexible tube, and the second member is inserted in the flexible tube. In another embodiment, the second member also includes a wire. In another embodiment still, the at least one leg also includes at least one bead affixed to the second member. In a related embodiment, the at least one bead is substantially ball-shaped. In an additional embodiment, the at least one bead has a diameter and the first member has an inner diameter that is less than the diameter of the at least one bead. In another embodiment, the first member further includes at least one bead-retaining locus. In still another embodiment, the bead-retaining locus further includes a first region within the first member having a first diameter, and at least one second region adjacent to the first region having a second diameter, the second diameter smaller than the first diameter. In still another embodiment, the bottle holder and at least one leg further include a wire frame.

Other aspects, embodiments and features of the device and method will become apparent from the following detailed description when considered in conjunction with the accompanying figures. The accompanying figures are for schematic purposes and are not intended to be drawn to scale. In the figures, each identical or substantially similar component that is illustrated in various figures is represented by a single numeral or notation. For purposes of clarity, not every component is labeled in every figure. Nor is every component of each embodiment of the system and method shown where illustration is not necessary to allow those of ordinary skill in the art to understand the device and method.

BRIEF DESCRIPTION OF THE DRAWINGS

The following detailed description of the device and method will be better understood when read in conjunction with the attached drawings. It should be understood that the system and method is not limited to the precise arrangements and instrumentalities shown.

DETAILED DESCRIPTION OF SPECIFIC EMBODIMENTS

Figure 1A:
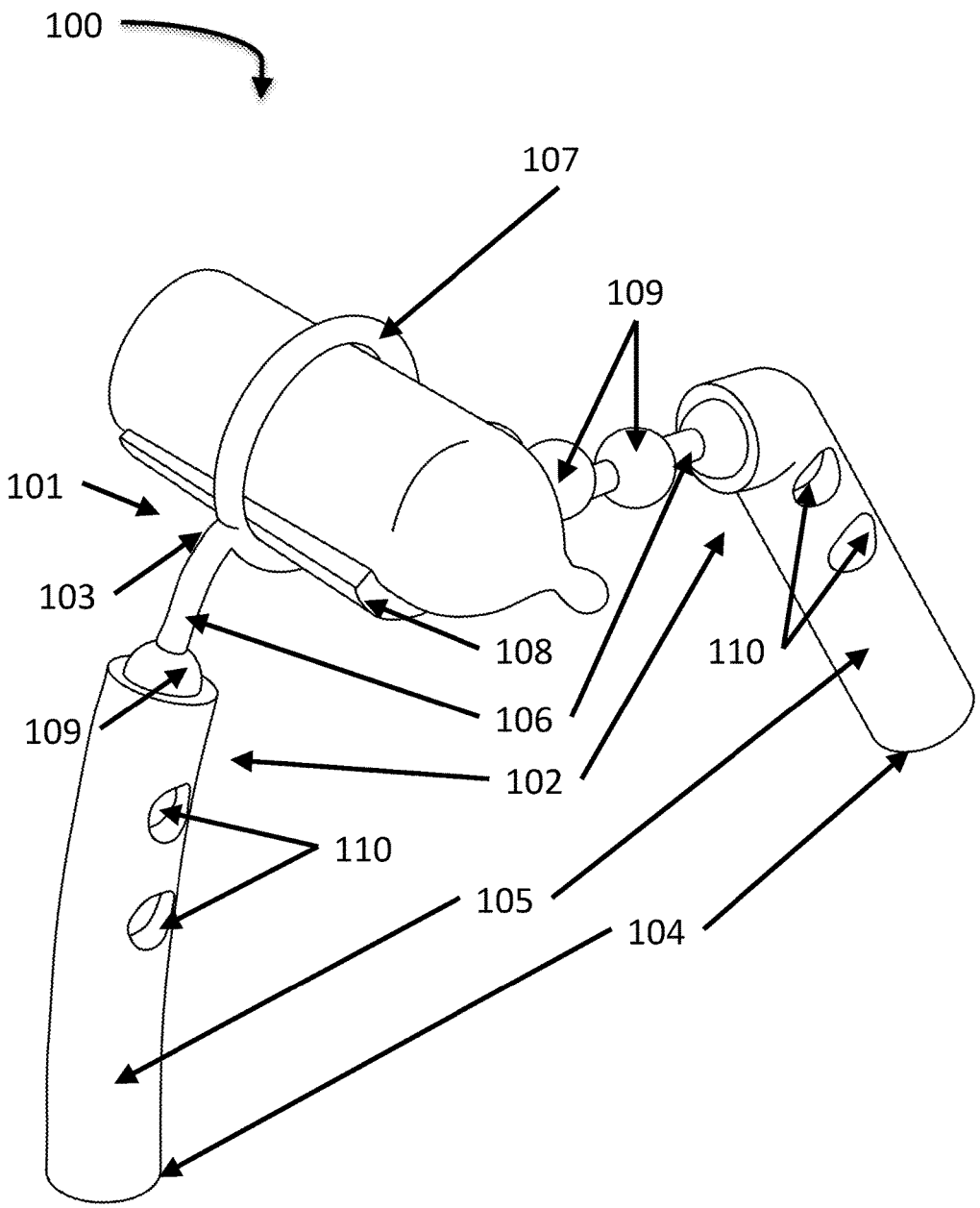
FIG. 1A is a schematic diagram showing one embodiment of the bottle stand.

Embodiments of the disclosed device allow a baby to be fed without the baby's caretaker having to hold the bottle, freeing up one or both hands of the caretaker. The design also may allow for the baby to grab the device ring and learn to hold the bottle in position. The ring material in some embodiments also acts as a teething ring for the baby. This device may be placed in any setting. For example, the device may work in a car seat, high chair, bouncer, or in a parent's arms. The support legs may be adjustable both by bending to desired poses and by extending their telescoping members.

FIG. 1 depicts one embodiment of a baby bottle stand 100. The bottle stand 100 includes a bottle holder 101. The baby bottle stand 100 includes at least one leg 102 having a proximal end 103 attached to the bottle holder 101 and a distal end 104 resting on a surface. The at least one leg 102 may be posably flexible. The at least one leg 102 may include a first member 105. The at least one leg 102 may include a second member 106 telescopically coupled to the first member 105.

Viewing FIG. 1 in further detail, the baby bottle stand 100 includes a bottle holder 101. In some embodiments, the bottle holder 101 is configured to hold a baby bottle in a position that allows an infant to access the nipple. The bottle holder 101 may include at least one loop 107. The at least one loop 107 may be constructed of any material or combination of materials. The at least one loop 107 may be constructed of materials including textiles made from natural or synthetic fibers; for instance, the at least one loop 107 may be a looped strap of textile. As another example, the at least one loop may include a textile covering over other materials. The at least one loop 107 may be constructed of materials including natural or synthetic polymers such as rubber or plastic. The at least one loop 107 may be constructed at least in part of elastomeric material.

Figure 2:
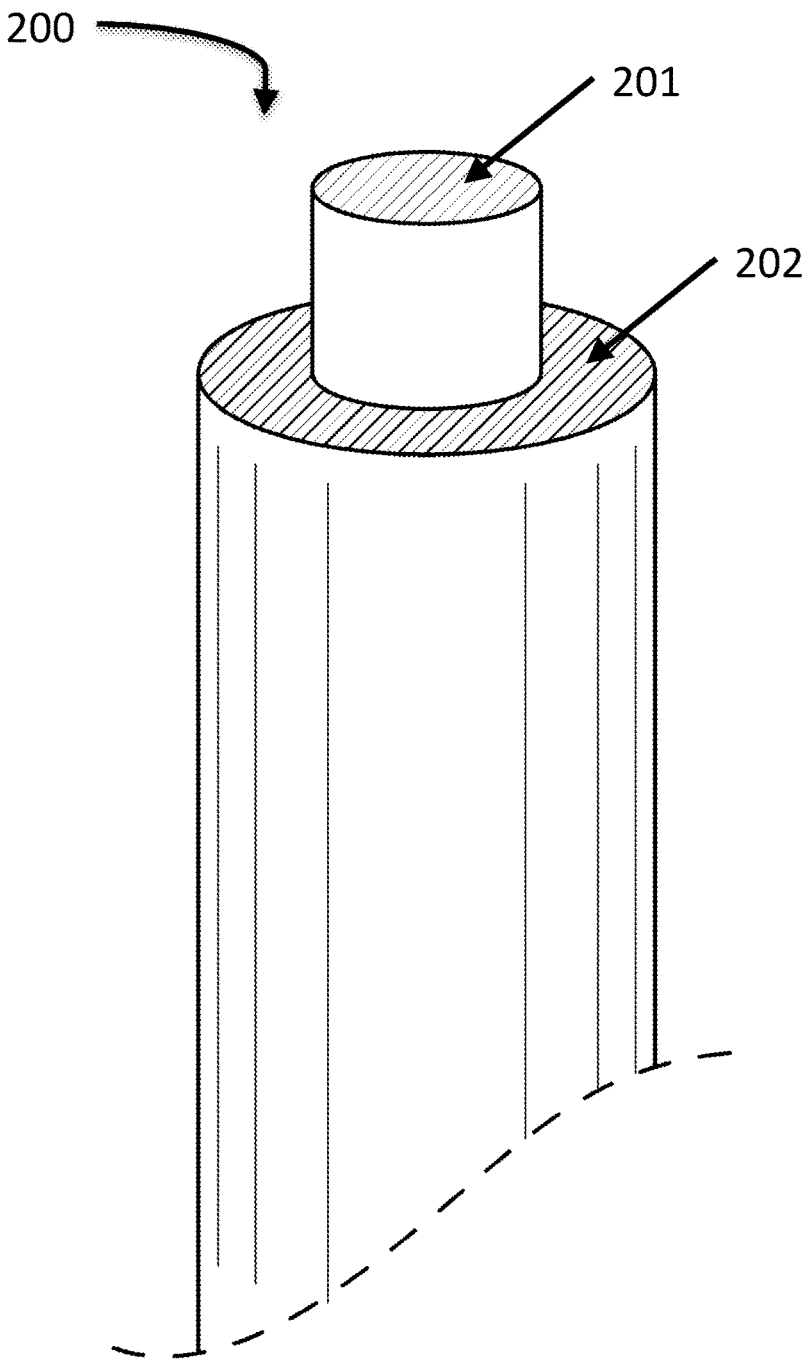
FIG. 2 is a schematic diagram showing one embodiment of a coated wire.

The at least one loop 107 may be constructed of metal wire; in some embodiments, the at least one loop 107 is constructed of a single strand of wire. In other embodiments, the at least one loop 107 is constructed of a plurality of strands of wire. The wire may be solid core wire. The wire may be stranded wire, which may be twisted; the wire may be a wire rope or cable. The wire may be braided wire. The wire may have any suitable gauge to produce a posably flexible leg as described herein. In some embodiments, the wire is made of metal. As illustrated in FIG. 2, the wire 200 may have a metal core 201 and an exterior coating 202; the exterior coating 202 may be made of materials including without limitation textile, polymeric, or elastomeric materials. The exterior coating 202 may be constructed like a teething ring; the materials used to construct the coating 202 may be flexible or elastomeric polymers that can deform when chewed on by an infant. In other embodiments, the coating 202 is constructed of hard plastic. The coating 202 may be textured. The coating 202 may have one or more colors. In some embodiments, the coating 202 is formed by placing the core 201 in a mold, and molding a polymer coating around the core 201; the molding process may involve any molding technology suitable for coating an object with a polymer material. The wire loop may have additional materials placed around it prior to the molding or coating step; for instance, gel material or other elements useful for teething may be placed about the wire prior to the molding step. The coating 202 may be applied by any other suitable process, such as spraying, as well. In other embodiments, the coating 202 surrounds a non-wire material such as gel or liquid suitable for teething rings, or a core of any other material described above as suitable for the at least one loop 107.

Figure 3:
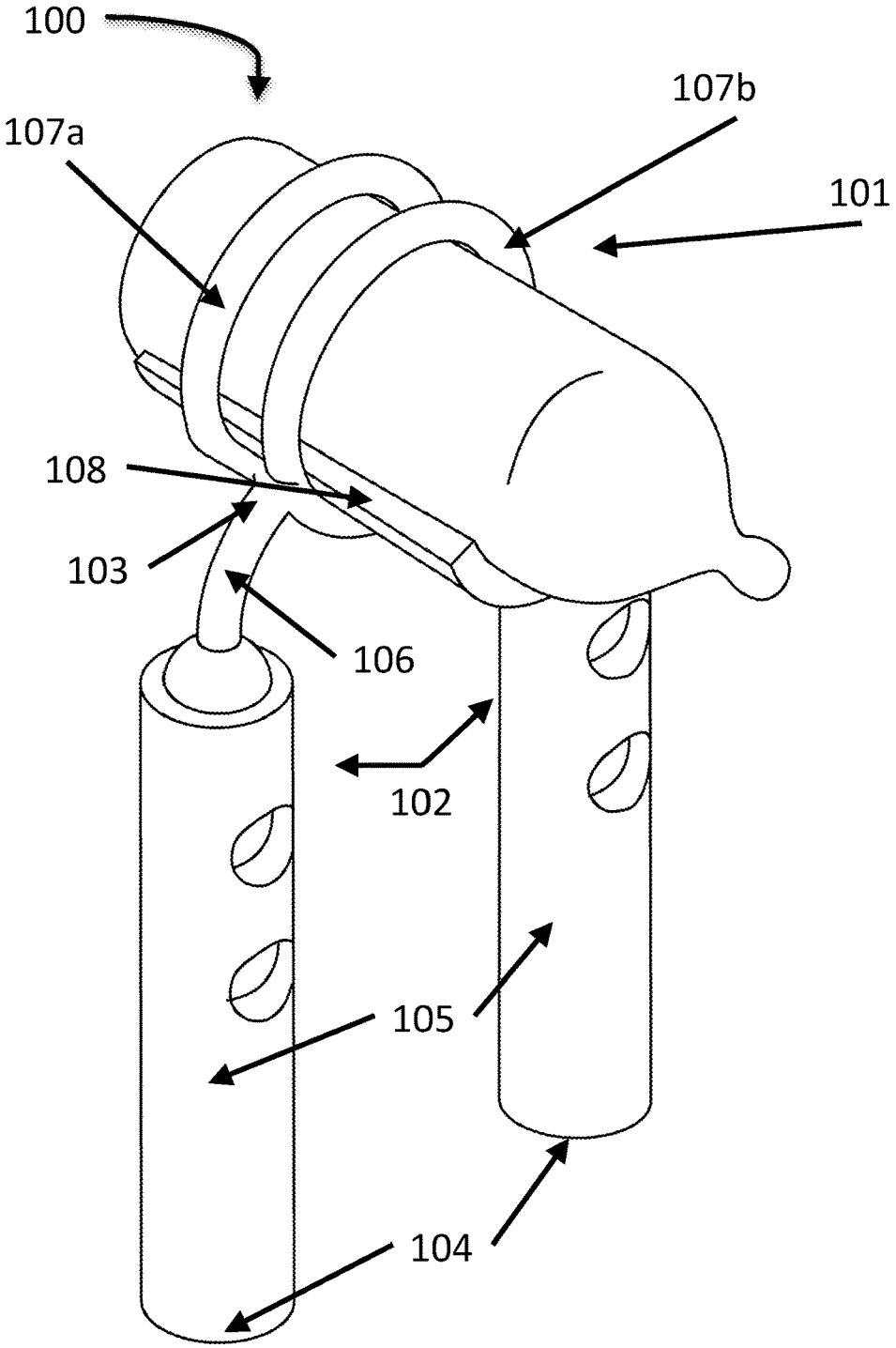
FIG. 3 is a schematic diagram showing one embodiment of the bottle stand.

As illustrated in FIG. 3, the at least one loop 107 may include two loops 107*a-b*; the two loops may include a front loop 107*b* and a rear loop 107*a*. In some embodiments, the bottle holder 101 is adjustable to fit snugly over bottles having various widths. The bottle holder 101 may be adjusted by changing the angle of one or more loops 107*a-b*; for instance, where the bottle holder 101 has a front loop 107*b* and a rear loop 107*a*, the bottle holder 101 may be tightened for a narrower bottle by bending the rear loop 107*a* so that it is closer to a horizontal angle, and loosened by bending the rear loop 107*a* in the opposite direction. The two loops 107*a-b* may be connected by one or more connectors, which may be formed using any materials described above for forming the loops 107*a-b*; the connectors may, for instance, be additional lengths of wire, or sheets or members made from textile, polymers, or other materials.

In some embodiments, the at least one loop 107 supports the bottle and gives an infant using it something to grasp. This may allow the infant to hold the bottle stand in position, enhancing its stability. Where the at least one loop 107 has a coating or otherwise presents a suitable texture, the baby may be able to use it for teething as well.

Returning to FIGS. 1A-B, in some embodiments, the bottle holder 101 includes a bottle holder pad 108. In some embodiments, the pad 108 is composed of one or more flexible materials. The flexible materials may include cloth, leather, natural polymers such as rubber, or synthetic polymers. The flexible materials may include a polymer foam; for instance, the materials may include closed-cell ethylene vinyl acetate (EVA) foam. The pad 108 may have any size conducive for supporting the bottle. In some embodiments, the pad 108 is between 3 and 8 inches long; for instance, the pad 108 may be approximately 4.3 inches long. The pad 108 may have the form of a mat that supports the bottle and prevents the bottle from slipping while in position. The mat may have a substantially concave upper surface on which the bottle rests; for instance, the mat may have a substantially a half-pipe form with a concave upper surface that accommodates the bottle. The substantially concave upper surface may be substantially shaped like a portion of the surface of the bottle; for instance, the substantially concave upper surface may describe an outer surface of a cylindrical section having a radius substantially equal to the radius of a bottle. The radius may be, for instance, between 0.75 and 1.5 inches. The mat may have a high-friction material such as non-stick tape on the surface on which the bottle is placed. In some embodiments, the bottle holder pad 108 tapers from a first thickness at a first end of the bottle holder to a second thickness at a second end of the bottle holder pad, wherein the second thickness is less than the first thickness; for instance, as shown in FIGS. 1A and 3, the pad 108 may be thicker at the end of the pad 108 where the bottle nipple is located, so that the concave space is narrower on that end, gripping the bottle more effectively and preventing slipping.

Figure 4A:
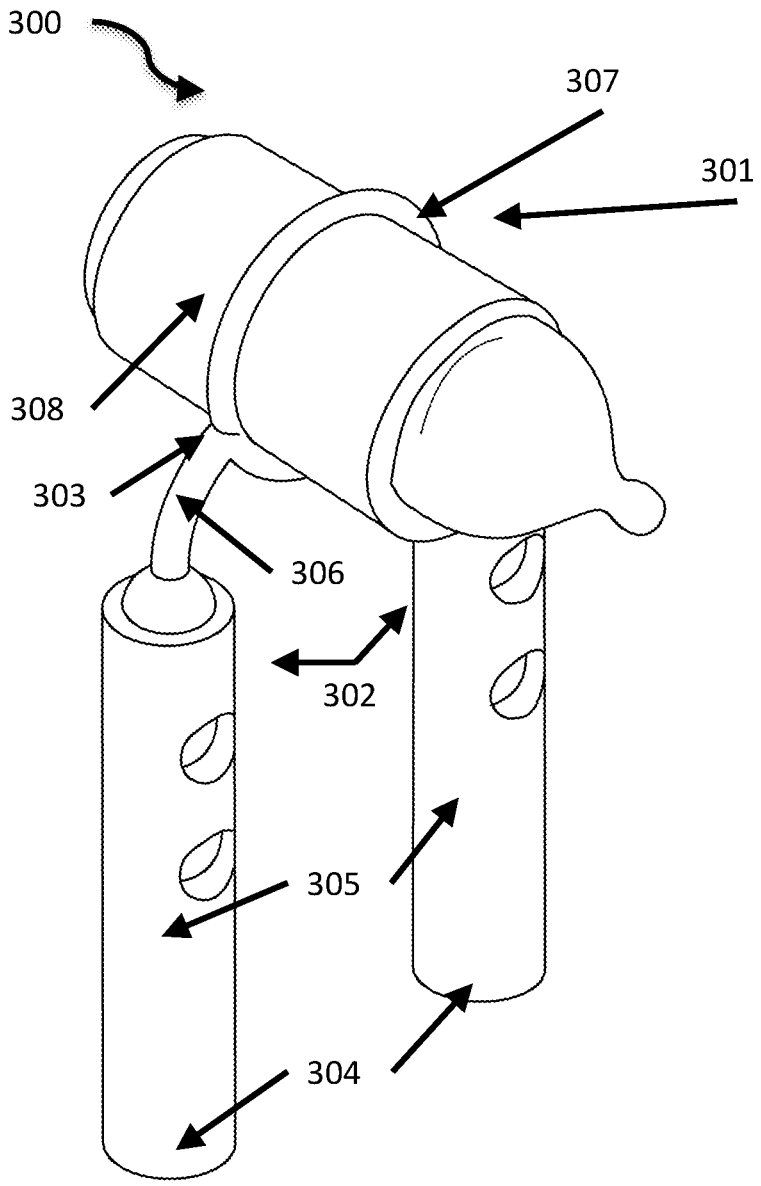
FIG. 4A is a schematic diagram showing one embodiment of the bottle stand.
Figure 4B:
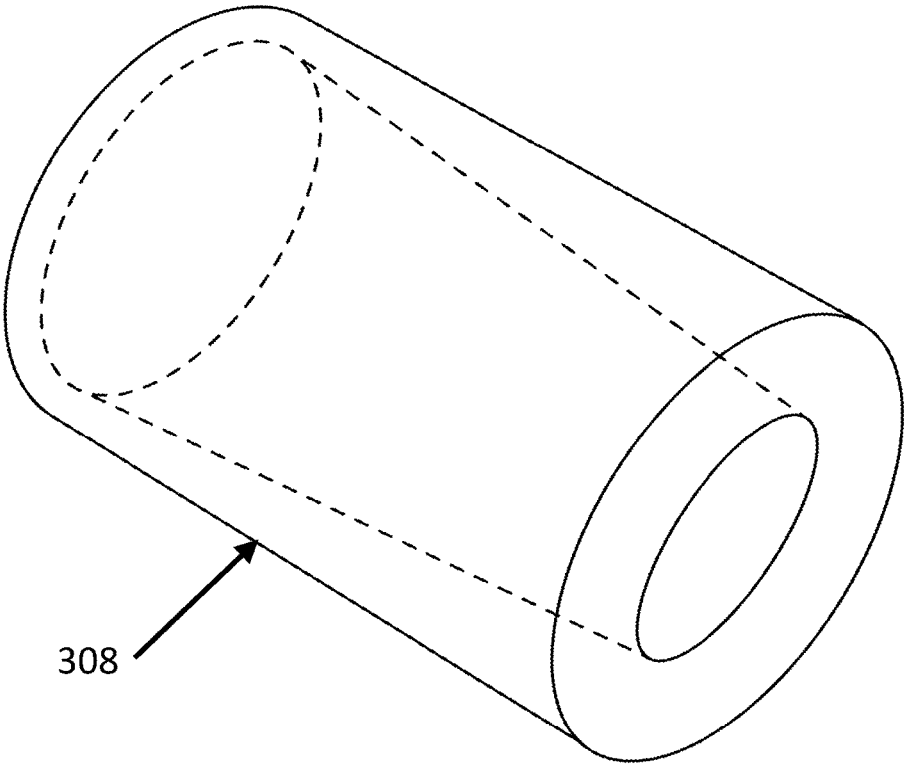
FIG. 4B is a schematic diagram showing one embodiment of a sleeve with a funnel-shaped interior.

In other embodiments, as shown for instance in FIGS. 4A-B, the bottle holder pad 108 has the form of a sleeve. In some embodiments, the sleeve 108 is a tube. The tube may have a substantially uniform cylindrical shape. Where the sleeve 108 is made of elastic material, the radius of the cylinder may be such that it stretches to accommodate typically sized bottles, with the result that the elastic compression exerted on the bottle by the sleeve 108 holds the bottle in place. In other embodiments, for example as shown in FIG. 4B, the tube is narrower at one end than the other; for instance, the tube may have a funnel-shaped interior, as shown in FIG. 4B, with the result that bottles of varying widths may be inserted into the tube and prevented from slipping out of the narrow end. The nipple of a bottle in the tube may protrude from the narrow end when the bottle stand 100 is in use.

The bottle holder 101 may include other elements to hold the bottle in place. For instance, in some embodiments the bottle holder 101 includes at least one strap (not shown) that encircles the bottle. The at least one strap may be secured by a buckle, such as a slide-release buckle or a tri-glide. The at least one strap may be adjustable; for instance, a user may be able to tighten the strap by pulling it through the buckle, so that it grips the bottle firmly. In other embodiments, the at least one strap is elastic, and may be stretched to grip the bottle firmly in a similar manner to that described for the tube above.

Returning to FIGS. 1A-B, the baby bottle stand 100 includes at least one leg 102 having a proximal end 103 attached to the bottle holder 101 and a distal end 104 resting on a surface. The at least one leg 102 may be composed of any material or combination of materials suitable for the construction of the bottle holder 101 as described above in reference to FIGS. 1A-4B. In some embodiments, the at least one leg includes at least one wire connected to the bottle holder 101 at the proximal end 103; for instance, the second member 106 may be constructed of a wire. The wire may be any wire suitable for use as a wire loop 107 as described above in reference to FIGS. 1A-B. In some embodiments, the wire and the wire loop 107 are created using a single length of wire, as described in further detail below.

In some embodiments, the at least one leg 102 is posably flexible. As used herein, the at least one leg 102 is posably flexible if it can be deformed by a user, exerting an amount of effort commensurate with the operation of household appliances, to a describe a curvature differing from an initial curvature, maintains the new curvature to which the user has deformed it while supporting the bottle, and can be so deformed large number of times without breaking; in some embodiments, the posably flexible leg 102 may be deformed an indefinitely large number of times without breaking. For instance, in some embodiments, the posably flexible leg exhibits apparently similar behavior to a one-way shape memory alloy that is below its transition temperature. Likewise, the posably flexible leg may exhibit similar behavior to polymer-insulated wires such as plastic-insulated copper wires, where the insulation prevents sufficiently sharp bending to fatigue the wire. The ability to bend the at least one leg 102 into various shapes may enable a user to change the height and angle at which the bottle is held by the bottle stand 100. The user may also be able to increase the stability of the bottle stand 100 by bending the wires to form a portion that lies along the surface, or by bending the wires to spread the two legs apart. The posably flexible leg 102 may be composed of a continuously flexible material or combination of materials, such as the wires and memory material described above, so that the posably flexible leg 102 may be deformed at an indefinitely large number of points over its length. In other embodiments, the posably flexible leg 102 is not continuously flexible, having one or more rigid portions separated by portions that allow posable flexion; for instance, in some embodiments, the at least one leg 102 includes one or more joints (not shown). For example, the at least one leg 102 may include at least one substantially rigid rod joined to the bottle holder 101 by a hinge, ball joint, or other flexible connector. The one or more joints may present enough friction to prevent the at least one leg 102 from shifting position unless moved by a user. In some embodiments, the at least one leg 102 includes at least two legs. For instance, the at bottle stand 100 may have two legs, which support the weight of the bottle together with the baby holding the bottle to the baby's mouth.

Figure 5:
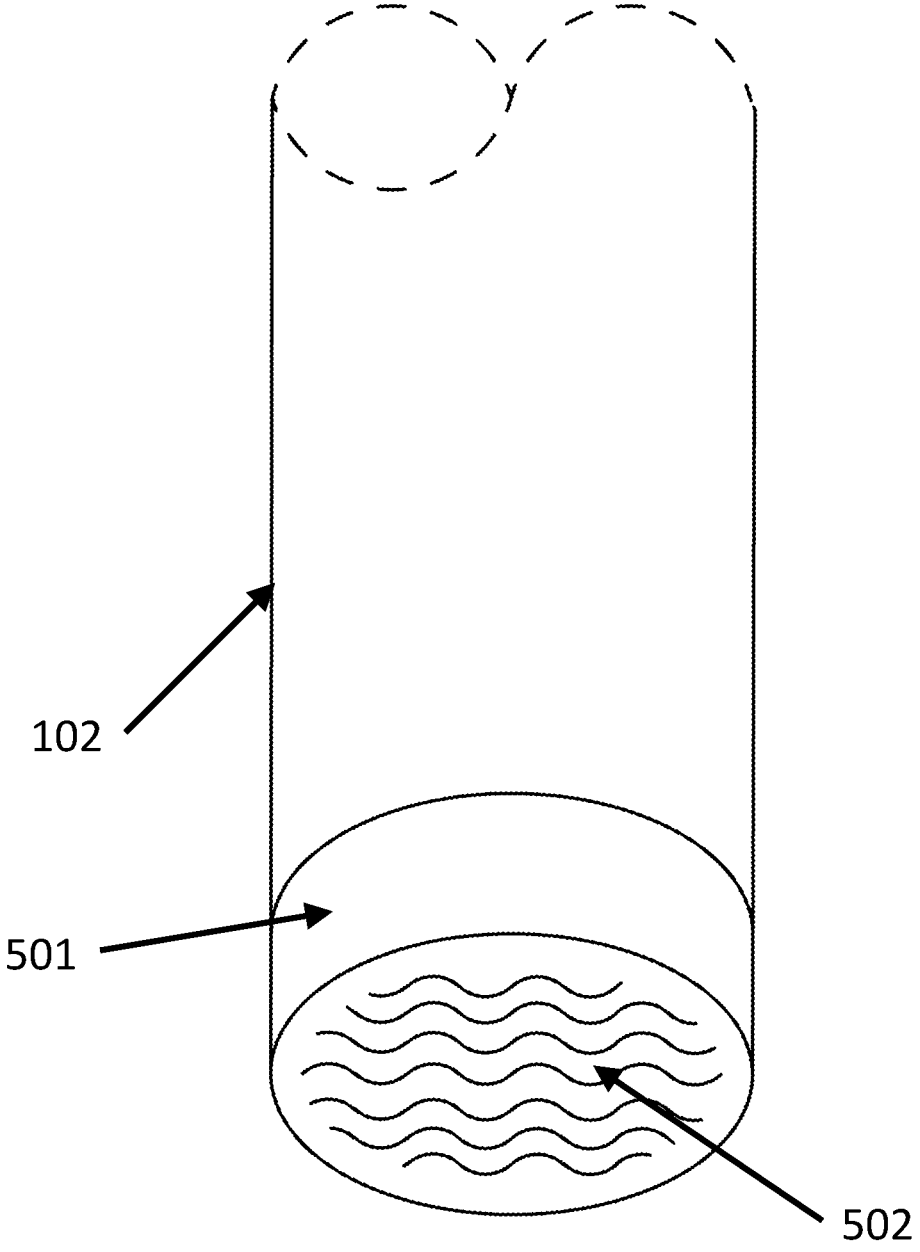
FIG. 5 is a schematic diagram showing one embodiment of a foot

In some embodiments, as shown for example in FIG. 5, the at least one leg 102 also includes at least one foot 501 at the distal end 104 of the at least one leg 102. The foot 501 may include a high-friction pad 502 that rests on the surface. In some embodiments, the pad is high-friction if its apparent coefficient of static friction (i.e. the coefficient of static friction observed upon empirical testing of the foot in use as part of the bottle stand) when placed against the surface is high enough to make the foot very unlikely to slip when in use. The apparent coefficient of static friction of the foot against the surface may be higher than 0.5. The high-friction pad 502 may be elastomeric. The high-friction pad 502 may have a textured surface, such as a ribbed or knurled surface, to prevent slippage. The foot 501 may be constructed of any materials suitable to achieve the desired result; in some embodiments, the materials making up the foot 501 may include an elastomeric polymer, such as rubber. The polymer may be synthetic or natural. The foot 501 may also include a weight; the weight may increase the stability of the bottle stand by lowering its center of gravity, and by increasing the friction force holding the foot 501 in place. In some embodiments, the foot 501 has a cup-like or bag-like portion with a filling that weights the foot 501. The filling may be bean-bag filling. In other embodiments, the foot 501 includes a metal weight. The foot 501 may include a magnet.

Returning to FIGS. 1A-B, the at least one leg 102 may include a first member 105. The first member 105 may be formed of any material or materials suitable for constructing the leg as a whole. The first member 105 may have any form suitable for use as described below; the form of the first member 105 may include a tube. The lumen of the tube may be a chamber in which the second member 106 is slidably engaged, as set forth in further detail below. The tube may be made of any suitable material or combination of materials. In some embodiments, the tube is flexible; materials making up the tube may include cloth. Materials making up the tube may include foam, such as closed-cell EVA foam. In some embodiments, the tube has a foam interior and a cloth exterior; in other words, the tube may be a foam tube with an exterior surface covered with cloth. In some embodiments, the tube terminates in the foot 501. For instance, the tube may be closed at the bottom and partially filled with bean bag fill. In other embodiments, the foot 501 includes a separate chamber that is filled with bean bag fill. The weight may also be placed between two layers of material at the foot; for instance, a metal weight may be placed between a first layer and a second layer of foam.

In some embodiments, the first member 105 is flexible; the first member 105 may be elastically flexible, meaning that the first member 105 will remain in a position to which it is deformed as long as it is held there by an outside force, but will return to its original form upon the cessation of the outside force. The first member 105 may be elastically flexible, for instance, if the first member 105 has the form of a tube made from foam or elastomeric material. In other embodiments, the first member 105 is posably flexible, as defined above. For instance, the first member 105 may have one or more wires (not shown) embedded in foam or similar material; the one or more wires may be posably flexible, and thus tend to keep the first member 105 in a position to which the user has deformed the first member 105.

The at least one leg 102 may include a second member 106 telescopically coupled to the first member 105. In some embodiments, the second member 106 is telescopically coupled to the first member 105 if the second member 106 and first member 105 are mutually slidable along an axis to extend the length of the leg when they are slid apart along the axis, and to contract the length of the leg when slid the together along the axis. For instance, the second member 106 may be telescopically inserted in the first member 105; the first member 105 may be a hollow structure such as a tube, as described above, and the second member may be formed to fit slidably within the hollow tube. The second member 106 may fit snugly within the first member 105; for instance, where the first member 105 is a hollow tube made of an elastic material such as polymer foam, the outer diameter of the second member 106 may be greater than the inner diameter of the tube, so that inserting the second member 106 in the tube stretches the tube and creates a recoil force squeezing the tube around the second member 106 and thus helping to hold the second member 106 in place.

The second member 106 may be constructed of any material or combination of materials suitable for the construction of the first member 105. In some embodiments, the second member 106 is elastically flexible. In other embodiments, the second member 106 is posably flexible. As a non-limiting example, the second member 106 may include a wire. The second member 106 may be attached at one end to the bottle holder 101.

In some embodiments, where the second member 106 is telescopically inserted in the first member 105, the at least one leg 102 includes at least one bead 109 affixed to the second member. In some embodiments, the at least one bead 109 is an object that is of greater width than the second member 106, such that the second member 106 effectively flanges outward to a greater thickness and then returns to the smaller original thickness again. The at least one bead 109 may be immobile with respect to the second member 106, so that when the second member 106 slides into or out of the tube, the bead slides with it.

Figure 6A:
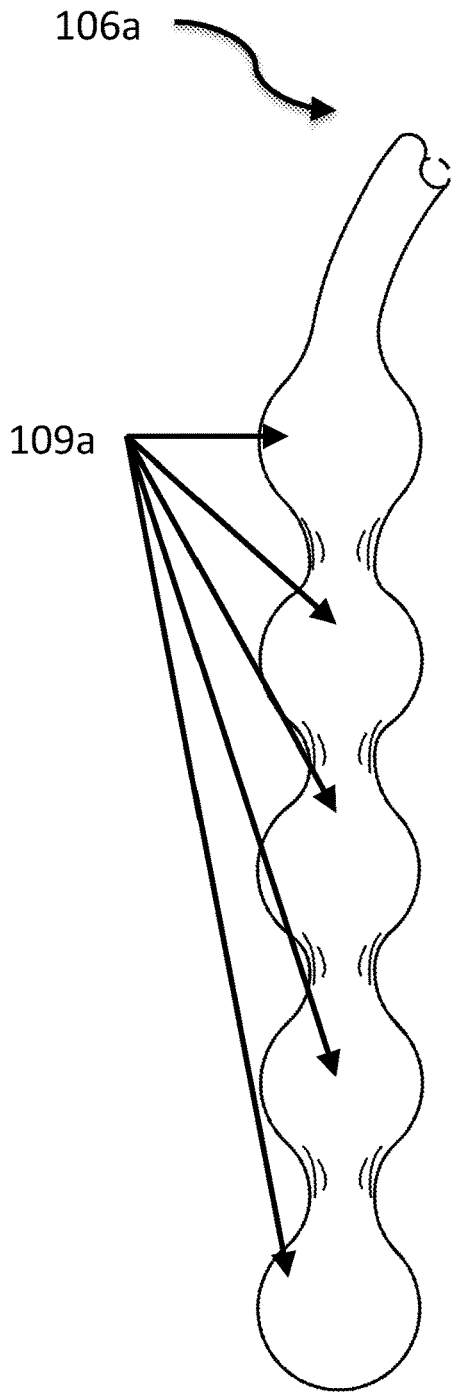
FIG. 6A is a schematic diagram showing one embodiment a member of a leg.
Figure 6B:
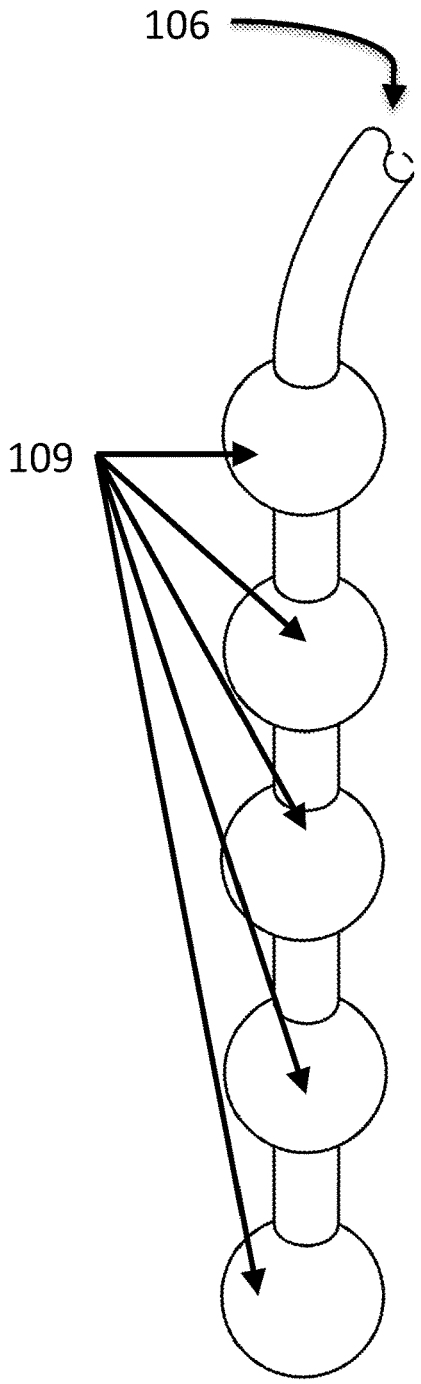
FIG. 6B is a schematic diagram showing one embodiment a member of a leg.

The at least one bead 109 may be constructed from any suitable material or materials, including plastic, other natural or artificial polymers, metal, wood, ceramics, or composite fibrous materials such as fiberglass. The at least one bead 109 may be manufactured using a molding procedure which casts plastic or other polymer bead shapes around a wire. For instance, the at least one bead 109*a* may be formed by inserting the wire in a mold with a succession of ball-shaped cavities and filling the mold with a polymer material, coating the wire and forming balls around the wire; these methods may result in a substantially monolithic structure of the second member 106*a* as shown in FIG. 6A. In other embodiments, the second member 106 is inserted through beads 109; the second member 106 and beads 109 may then be coated with a polymer material, or the second member 106 and beads 109 may be visibly distinct as in FIG. 6B. The at least one bead 109 may have any suitable shape including a spheroid, a regular or irregular polyhedron, or a combination of various planar and curved portions. The at least one bead 109 may be substantially ball-shaped. The at least one bead 109 may be a plurality of beads. The at least one bead 109 may help to secure the second member 106 in a desired position within the first member 105 by enhancing the friction between the two members, while allowing for the leg 102 to remain posably flexible.

Figure 1B:
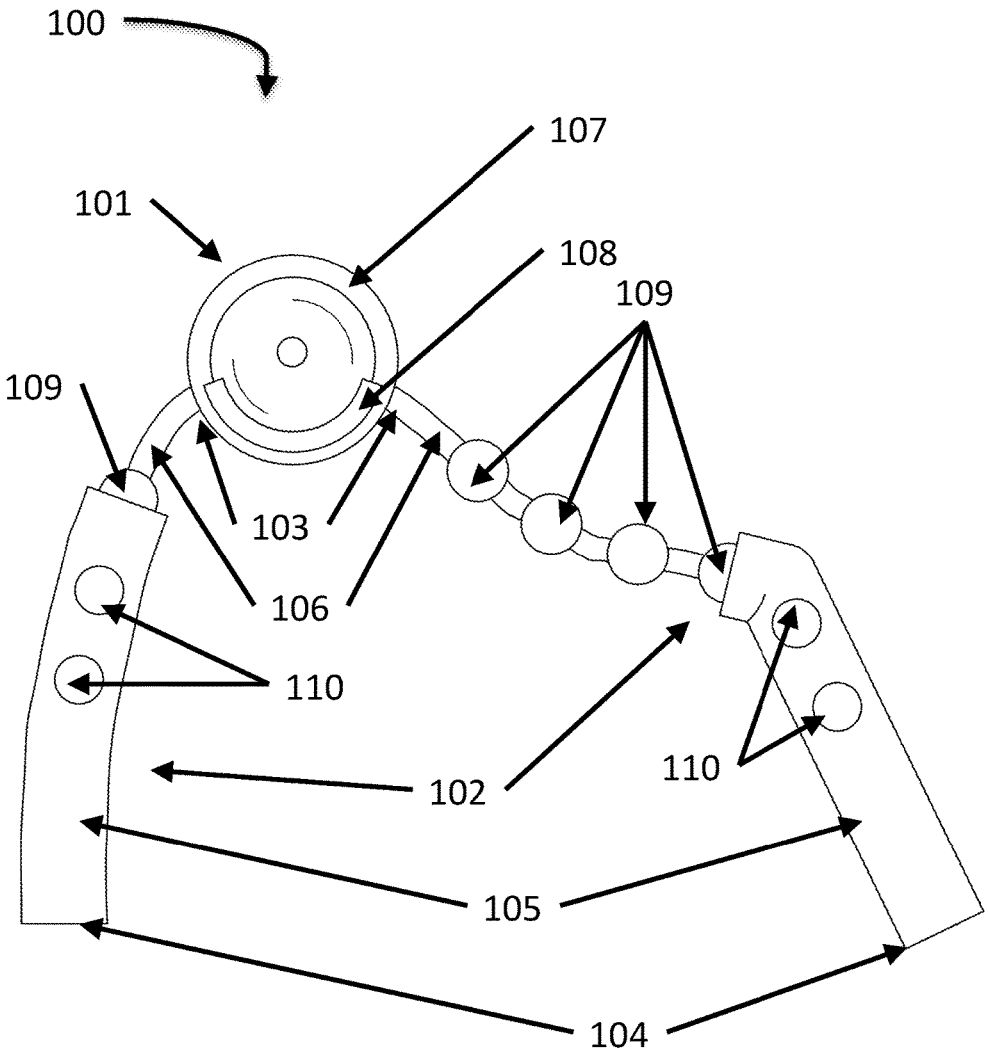
FIG. 1B is a schematic diagram showing one embodiment of the bottle stand.
Figure 7A:
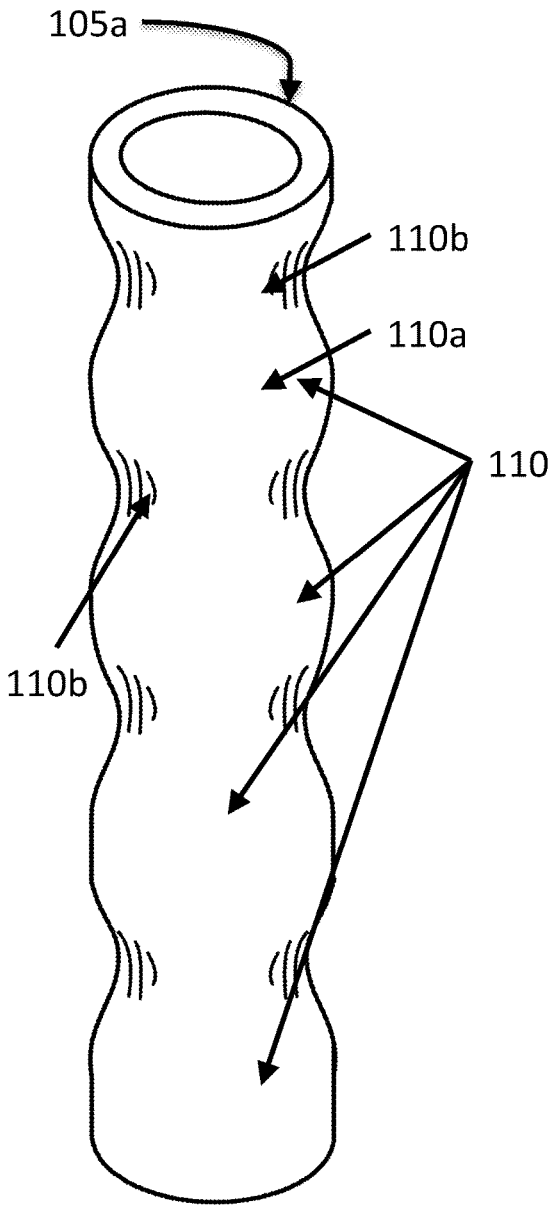
FIG. 7A is a schematic diagram showing one embodiment a member of a leg.
Figure 7B:
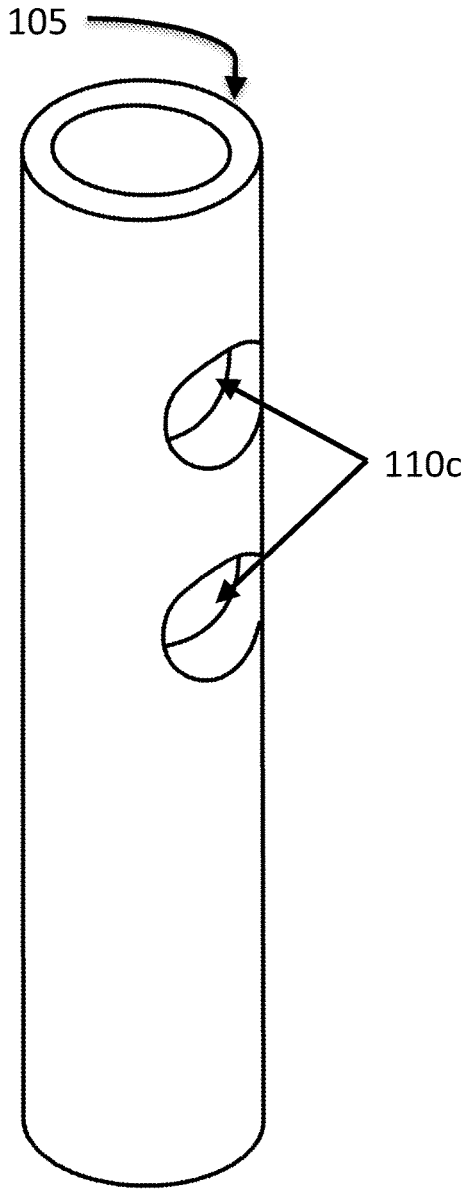
FIG. 7B is a schematic diagram showing one embodiment a member of a leg.
Figure 7C:
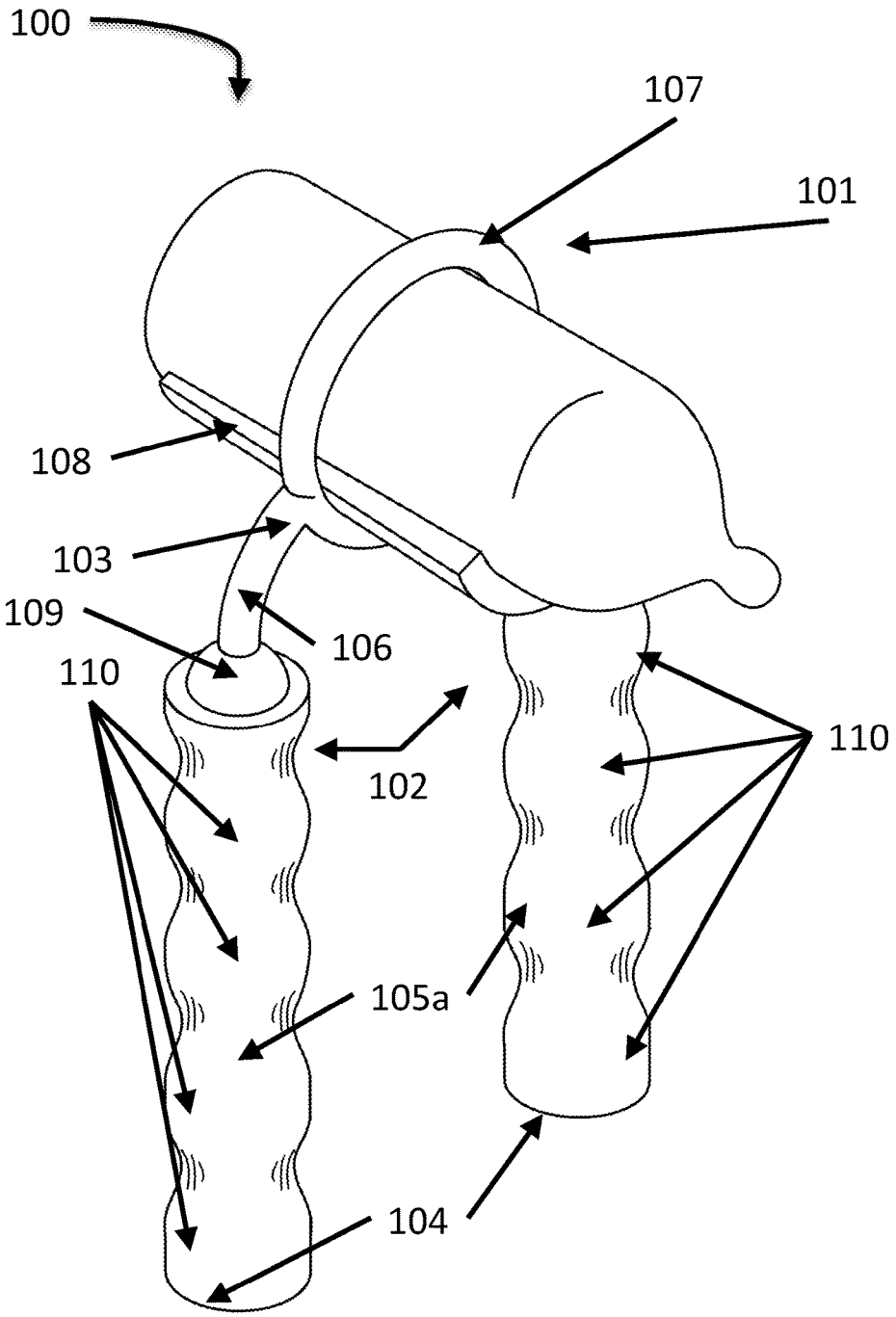
FIG. 7C is a schematic diagram showing one embodiment of the bottle stand.

In some embodiments where the second member 106 is affixed to one or more beads 109 and inserted in the first member 105, the first member 105 also includes at least one bead-retaining locus 110. In some embodiments, a bead-retaining locus 110 is a location within the tube that is formed to resist moving a bead 109 in the location away from the locus 110. As shown in FIG. 7A, the bead-retaining locus 110 may be a first region 110*a* within the first member having a first diameter, and at least one second region 110*b* adjacent to the first region having a second diameter, the second diameter smaller than the first diameter. The second diameter 110*b* may be small enough that a bead 109 cannot pass through it without stretching the first member 105*a* in that location. As a result, the second member 106 may tend to be retained in a position within the first member 105*a* in which the bead is located in the locus, as shown for example in FIG. 7C. In other embodiments, as shown in FIG. 7B, the bead-retaining locus 110 includes a hole 110*c* in the first member. In some embodiments, the bead 109 inserts into the hole 110*c* when moved to the bead-retaining locus, for instance as illustrated in FIGS. 1A-B.

Users skilled in the art will appreciate that the roles of the first 105 and second 106 members in this description may be reversed; for instance, the second member 106 may be a tube with a chamber, and the first member 105 may be slidably engaged in the chamber. Likewise, the first member 105 may have one or more beads affixed to it.

In some embodiments, the bottle holder 101 and the at least one leg 102 include a wire frame. The wire frame may be made up of the combination of the at least one loop 107 in the bottle holder 101 and the at least one wire of the at least one leg 102. In some embodiments, the wire frame is made up of a single length of wire, folded and bent to form the at least one loop 107 and the at least one wire. For instance, the frame may be made using a 5-foot length of wire that is folded over itself at least once and molded into a shape including the at least one loop 017 and the at least one wire. In some embodiments, the use of a single piece of wire gives the bottle stand 100 flexibility while also preventing weak joints that may form when joining multiple pieces together. In other embodiments, the wire frame is made by molding or otherwise joining together wire elements in the at least one leg 102 and the bottle holder 101. The wire frame may be coated by teething materials, balls, and polymer coating as described above; for instance, where the wire frame includes at least one wire loop 107 and at least one leg 102, the entire frame may be inserted into a mold for coating, with elements added to the leg 102 and at least one wire frame before or during the molding process as described above.

Figure 8:
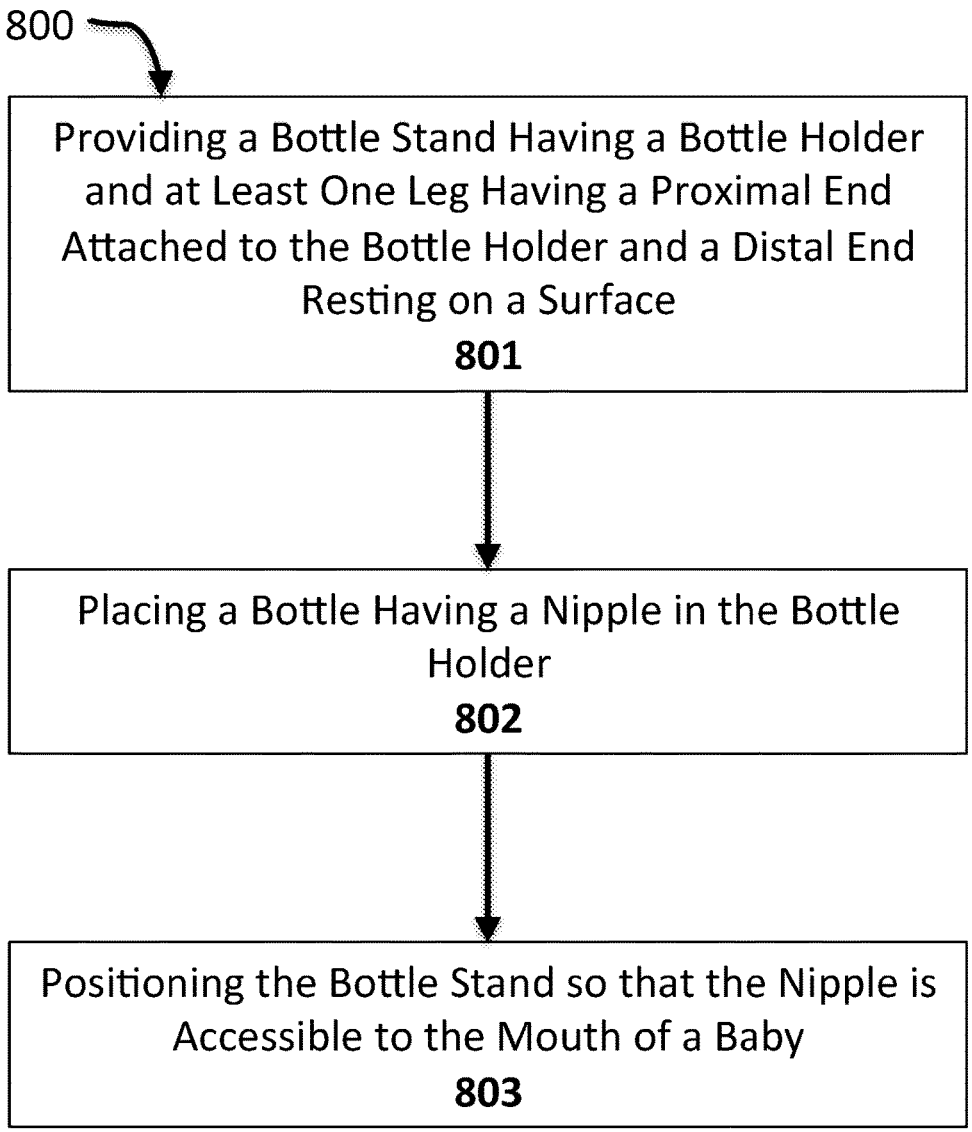
FIG. 8 is a flow diagram illustrating a method for feeding an infant using a bottle stand.

FIG. 8 is a flow chart depicting a method 800 for feeding an infant using a bottle stand. The method 800 includes providing a bottle stand having a bottle holder and at least one leg having a proximal end attached to the bottle holder and a distal end resting on a surface (801). The method 800 includes placing a bottle having a nipple in the bottle holder (802). The method 800 includes positioning the bottle stand so that the nipple is accessible to the mouth of a baby (803).

Referring to FIG. 8 in greater detail, and by reference to FIGS. 1A-7C, the method 800 includes providing a bottle stand 100 having a bottle holder and at least one leg having a proximal end attached to the bottle holder and a distal end resting on a surface (801). The bottle holder 100 may be any bottle holder 100 as described above in reference to FIGS. 1A-7C.

The method 800 includes placing a bottle having a nipple in the bottle holder (802). In some embodiments, the method 800 includes securing the bottle in the bottle holder 101, for instance by adjusting one or more wire loops. The method 800 may include adjusting the bottle holder 101 to fit the bottle, as described above in reference to FIGS. 1A-7C.

The method 800 includes positioning the bottle stand so that the nipple is accessible to the mouth of a baby (803). In some embodiments, where the at least one leg 102 is two legs, one leg is placed on either side of a baby that is reclining on her back. The method may include bending one or more of the legs 102 or sliding the first member 105 with respect to the second member 106 to adjust the length of the legs, as described above in reference to FIGS. 1A-7C. The baby may provide some support for the bottle stand 100; for instance, the insertion of the nipple into the baby's mouth may act similarly to the third leg of a tripod holding the bottle up. The baby may grasp the bottle stand 100; where the bottle stand 100 has at least one loop 107, the baby may grasp the bottle stand 100 by the wire loop 107.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A bottle stand, the bottle stand comprising:

a bottle holder; and at least one leg having a proximal end attached to the bottle holder and a distal end resting on a surface, the at least one leg comprising a first member and a second member telescopically coupled to the first member, wherein the at least one leg is flexible; the first member comprises a flexible tube, and the second member is inserted in the flexible tube; the at least one leg further comprises at least one bead affixed to the second member, and the first member further comprises at least one bead-retaining locus, the bead-retaining locus comprises a first region within the first member having a first diameter, and at least one second region adjacent to the first region having a second diameter, the second diameter smaller than the first diameter for engaging with the at least one bead and thereby retaining a position of the second member within the first member.

2. The bottle stand of claim 1 wherein the bottle holder further comprises at least one loop.

3. The bottle stand of claim 1, wherein the bottle holder further comprises a bottle holder pad.

4. The bottle holder of claim 3, wherein the bottle holder pad tapers from a first thickness at a first end of the bottle holder pad to a second thickness at a second end of the bottle holder pad, wherein the second thickness is less than the first thickness.

5. The bottle stand of claim 1, wherein the at least one leg further comprises a wire connected to the bottle holder at the proximal end.

6. The bottle stand of claim 1, wherein the at least one leg further comprises a foot at the distal end of the at least one leg.

7. The bottle stand of claim 6, wherein the foot further comprises a high-friction pad that rests on the surface.

8. The bottle stand of claim 1, wherein the second member further comprises a wire.

9. The bottle stand of claim 1, wherein the at least one bead is substantially ball-shaped.

10. The battle stand of claim 1, wherein the at least one bead has a diameter and the second diameter of the first member is less than the diameter et the at least one bead.

11. The bottle stand of claim 1, wherein the bottle holder and the at least one leg further comprise a wire frame.

* * * * *